US011774140B2

(12) United States Patent
Hayden et al.

(10) Patent No.: US 11,774,140 B2
(45) **Date of Patent: *Oct. 3, 2023**

(54) NEXT GENERATION BARE WIRE WATER HEATER

(71) Applicant: EEMAX, INC., Atlanta, GA (US)

(72) Inventors: Christopher M. Hayden, Shelton, CT (US); Eric R. Jurczyszak, Berlin, CT (US); Jeff Hankins, Southbury, CT (US)

(73) Assignee: Rheem Manufacturing Company, Atlanta, GA (US)

( * ) Notice: Subject to any disclaimer, the term of this patent is extended or adjusted under 35 U.S.C. 154(b) by 165 days.

This patent is subject to a terminal disclaimer.

(21) Appl. No.: 17/171,593

(22) Filed: Feb. 9, 2021

(65) Prior Publication Data

US 2021/0239362 A1 Aug. 5, 2021

Related U.S. Application Data

(63) Continuation of application No. 16/162,763, filed on Oct. 17, 2018, now Pat. No. 10,914,492, which is a (Continued)

(51) Int. Cl.
*F24H 9/20* (2022.01)
*F24H 9/1818* (2022.01)
(Continued)

(52) U.S. Cl.
CPC ..... *F24H 9/2028* (2013.01); *F24H 1/142* (2013.01); *F24H 9/1818* (2013.01); (Continued)

(58) Field of Classification Search
CPC ..... F24H 1/142; F24H 9/1818; F24H 9/2014; F24H 9/2028; F24H 2250/02; H05B 3/16; H05B 3/46
(Continued)

(56) References Cited

U.S. PATENT DOCUMENTS

X270478 1/1883 Pumphrey
X601585 3/1898 McElroy
(Continued)

FOREIGN PATENT DOCUMENTS

CN 201844531 5/2011
DE 197 26 288 A1 6/1997
JP 11-148716 6/1999

OTHER PUBLICATIONS

International Search Report dated Jun. 5, 2013 in PCT/US2013/032298, filed Mar. 15, 2013.
(Continued)

*Primary Examiner* — Eric S Stapleton
(74) *Attorney, Agent, or Firm* — Eversheds Sutherland (US) LLP

(57) ABSTRACT

A heating unit for heating fluid is described having at least one electrical resistance heating element on an outer surface of a tube. At least one indexed groove is provided around a surface of the tube allowing for at least one retention clip to hold the electrical resistance heating element. A heating chamber is also provided to enclose a portion of the tube and to provide a flow channel therebetween. The heating chamber includes an optical sensor to detect overheating of the at least one electrical resistance heating element. Fluid is heated by flowing over the surface of the at least one electrical resistance heating element and through the tube.

20 Claims, 6 Drawing Sheets

Related U.S. Application Data continuation of application No. 14/951,001, filed on Nov. 24, 2015, now Pat. No. 10,139,136, which is a continuation of application No. 13/835,346, filed on Mar. 15, 2013, now Pat. No. 9,234,674.

(60) Provisional application No. 61/740,653, filed on Dec. 21, 2012.

(51) Int. Cl.
*H05B 3/16* (2006.01)
*H05B 3/46* (2006.01)
*F24H 1/14* (2022.01)

(52) U.S. Cl.
CPC ..... *F24H 9/2014* (2013.01); *H05B 3/16* (2013.01); *H05B 3/46* (2013.01); *F24H 2250/02* (2013.01)

(58) Field of Classification Search
USPC ..... 392/480
See application file for complete search history.

(56) References Cited

U.S. PATENT DOCUMENTS 1,329,204 A * 1/1920 Patterson ..... F24H 1/202 392/452
1,718,970 A * 7/1929 Lonergan ..... F24H 1/102 122/18.1
1,729,483 A 9/1929 Koch
1,777,744 A 10/1930 Breuer
1,821,525 A 9/1931 Nielsen
1,851,851 A 3/1932 Lee et al.
2,032,416 A * 3/1936 Hunt ..... H02G 3/06 16/108
2,041,687 A * 5/1936 Benson ..... A45D 20/10 415/206
2,224,422 A * 12/1940 Ballman ..... H02P 1/42 338/241
2,360,019 A * 10/1944 Ryan ..... B64C 3/00 403/44
2,576,298 A * 11/1951 Kessler ..... F16B 2/248 403/247
2,589,566 A * 3/1952 Neth ..... F24D 3/00 122/13.3
2,681,409 A * 6/1954 Dobbins ..... B64D 15/12 338/237
2,730,609 A * 1/1956 Constantinesco ..... B23K 1/012 392/476
2,824,199 A * 2/1958 Browne ..... H05B 3/46 338/270
2,996,316 A * 8/1961 Terhune ..... F42B 15/36 411/440
3,088,017 A * 4/1963 Schomann ..... F24H 1/103 392/494
3,108,174 A * 10/1963 Hynes ..... F24H 3/0405 252/372
3,310,769 A * 3/1967 Simmons ..... H05B 3/48 219/544
3,313,821 A * 4/1967 Lekberg ..... C07D 213/803 546/320
3,313,921 A * 4/1967 Mohn ..... H05B 3/44 392/407
3,329,455 A * 7/1967 Becker ..... F16L 3/01 403/104
3,447,746 A * 6/1969 Visos ..... F23N 1/087 236/102
3,512,114 A * 5/1970 Dzaack ..... H05B 3/48 338/273
3,576,646 A * 4/1971 Alwood ..... A47J 31/053 250/226
3,622,750 A * 11/1971 Watts, Jr. ..... H05B 3/16 392/407
3,625,549 A * 12/1971 De Vries ..... F16L 21/06 285/39
3,633,748 A * 1/1972 Hanley ..... C02F 1/325 210/186
3,921,505 A * 11/1975 Wunsch ..... F16J 10/02 92/169.1
3,977,073 A * 8/1976 Shirey ..... H05B 3/48 205/213
4,056,143 A * 11/1977 Martin ..... F28F 1/22 165/125
4,142,515 A * 3/1979 Skaats ..... F24D 17/0031 122/13.3
4,185,187 A * 1/1980 Rogers ..... F24H 9/2014 392/471
4,242,775 A * 1/1981 Eickmann ..... F16B 21/18 403/326
4,250,399 A * 2/1981 King ..... H05B 3/32 219/532
4,270,367 A * 6/1981 Santore ..... F16D 3/06 464/169
4,338,888 A * 7/1982 Gerstmann ..... F24H 1/40 122/18.4
4,371,777 A * 2/1983 Roller ..... H05B 3/14 219/505
4,439,669 A * 3/1984 Ryffel ..... F22B 1/30 338/80
4,460,201 A * 7/1984 McGugan ..... E21B 17/046 285/365
4,531,017 A * 7/1985 Sherrill ..... H05B 3/16 219/532
4,600,334 A * 7/1986 Soussloff ..... F16D 1/094 242/573
4,628,189 A * 12/1986 Danko ..... H05B 3/32 219/532
4,675,511 A * 6/1987 Sherrill ..... H05B 3/16 219/532
4,682,578 A * 7/1987 Schmidt ..... F24C 1/12 126/91 R
4,693,179 A * 9/1987 Watts ..... B41F 15/0809 219/471
4,762,980 A * 8/1988 Insley ..... F24H 1/103 392/494
4,775,258 A * 10/1988 Lange ..... E04H 12/10 403/171
4,808,793 A * 2/1989 Hurko ..... F24H 1/102 392/480
4,813,992 A * 3/1989 Hale ..... C03B 11/14 65/59.27
4,835,365 A * 5/1989 Etheridge ..... H01R 43/00 392/491
4,885,840 A * 12/1989 McManus ..... H05B 3/32 219/532
4,892,432 A * 1/1990 Cooper ..... F16B 7/0413 192/53.35
5,054,108 A 10/1991 Gustin et al.
5,122,640 A * 6/1992 Holmes ..... H05B 3/32 219/532
5,124,534 A * 6/1992 Williams ..... H05B 3/32 219/532
RE34,018 E 8/1992 Petersen et al.
5,138,693 A * 8/1992 Knauss ..... F22B 1/282 134/107
5,216,743 A 6/1993 Seitz
5,243,185 A * 9/1993 Blackwood ..... G01N 21/211 250/225
5,269,572 A * 12/1993 Mefferd ..... F16L 21/06 403/339
5,293,446 A * 3/1994 Owens ..... F24H 1/202 122/18.1
5,308,207 A * 5/1994 Jaskowiak ..... F16B 21/12 411/513
5,325,822 A * 7/1994 Fernandez ..... F24H 1/102 219/486
5,329,098 A * 7/1994 Howard ..... F24H 9/1818 392/350

(56) References Cited

U.S. PATENT DOCUMENTS 5,384,032 A * 1/1995 de Souza ..... C02F 9/005 210/264
5,400,432 A * 3/1995 Kager ..... H05B 3/42 392/492
5,408,577 A * 4/1995 Weber, Jr. ..... G05D 23/2401 219/535
5,408,578 A 4/1995 Bolivar
5,549,078 A * 8/1996 Annecharico ..... C02F 1/04 392/397
5,559,924 A * 9/1996 Kadotani ..... H05B 3/0052 392/483
5,578,232 A * 11/1996 Engelke ..... H05B 3/16 219/532
5,628,895 A * 5/1997 Zucholl ..... C02F 1/325 210/85
5,658,478 A * 8/1997 Roeschel ..... H05B 3/746 219/665
5,740,315 A * 4/1998 Onishi ..... F24H 1/121 392/483
5,772,355 A * 6/1998 Ross ..... G02B 23/2484 403/321
5,783,805 A * 7/1998 Katzmann ..... G01R 19/225 219/486
5,862,303 A * 1/1999 Adar ..... F24H 1/142 148/403
5,895,597 A * 4/1999 Sherrill ..... H05B 3/16 219/532
5,925,273 A * 7/1999 Sherrill ..... H05B 3/16 219/532
5,930,458 A * 7/1999 Yane ..... F24H 1/121 392/492
5,959,254 A * 9/1999 Martin, Sr. ..... H05B 3/16 219/536
5,981,919 A * 11/1999 Masten, Jr. ..... F27D 19/00 148/698
5,995,711 A * 11/1999 Fukuoka ..... B60H 1/00328 219/202
6,005,225 A * 12/1999 Kowalski ..... H01L 21/67098 219/390
6,020,577 A * 2/2000 Barker ..... H01C 1/012 338/315
6,043,466 A * 3/2000 Jenko ..... B29C 45/2737 219/535
6,055,360 A * 4/2000 Inoue ..... F24H 3/0435 165/151
6,091,890 A * 7/2000 Gruzdev ..... F24H 1/225 432/29
6,097,007 A * 8/2000 Wang ..... A01K 63/065 392/408
6,157,778 A * 12/2000 Kadotani ..... F24H 1/142 392/483
6,199,515 B1 * 3/2001 Clarke ..... F24H 9/133 122/13.01
6,231,194 B1 * 5/2001 Raj ..... G02B 27/1066 353/122
6,236,810 B1 * 5/2001 Kadotani ..... H01L 35/00 392/483
6,240,250 B1 5/2001 Blanco, Jr.
6,246,831 B1 6/2001 Seitz et al.
6,252,220 B1 * 6/2001 Jedlicka ..... H01L 27/1462 358/474
6,253,121 B1 * 6/2001 Cline ..... H02H 5/105 361/115
6,259,070 B1 * 7/2001 Audet ..... D06F 58/26 219/532
6,282,370 B1 * 8/2001 Cline ..... H02H 5/105 392/485
6,285,013 B1 * 9/2001 Holmes ..... H01C 3/20 219/532
6,297,740 B1 * 10/2001 Hill ..... G01J 1/04 340/425.5
6,345,769 B2 * 2/2002 MacIntyre ..... F24D 12/02 237/8 R
6,355,913 B1 * 3/2002 Authier ..... A61H 33/00 219/502
6,509,554 B2 * 1/2003 Howard ..... H05B 3/32 219/536
6,538,238 B1 * 3/2003 Berkcan ..... H05B 3/746 219/501
6,577,926 B1 * 6/2003 Chang ..... G05B 9/02 219/490
6,593,553 B2 * 7/2003 Whitfield ..... H05B 3/16 219/454.12
6,607,608 B1 * 8/2003 Vetrano ..... G02B 6/245 239/128
D495,298 S 8/2004 Keathley
6,909,843 B1 * 6/2005 Fabrizio ..... F24H 9/2028 392/485
6,942,892 B1 * 9/2005 Ishibashi ..... C23C 16/4405 118/723 HC
7,007,316 B2 * 3/2006 Lutz, II ..... G05D 23/1393 4/620
7,038,305 B1 5/2006 Chet et al.
7,046,922 B1 * 5/2006 Sturm ..... F24H 9/2028 392/482
7,075,043 B2 7/2006 Howard et al.
7,156,425 B2 * 1/2007 Atkinson ..... F16L 41/021 285/133.11
7,190,894 B2 3/2007 Chamberlain, Jr.
7,293,914 B2 * 11/2007 Wang ..... G01K 1/02 374/E1.002
7,324,746 B2 * 1/2008 Tanaka ..... F24H 1/142 219/541
7,414,223 B2 * 8/2008 Janhunen ..... C03B 27/0417 219/400
7,592,572 B2 9/2009 Schlipf
7,593,625 B2 * 9/2009 Kamikawa ..... F24H 1/101 392/393
7,657,961 B2 * 2/2010 Shank ..... B60S 1/488 392/480
7,744,008 B2 * 6/2010 Chapman, Jr. ..... F24H 9/2007 62/157
7,857,002 B2 * 12/2010 Reck ..... F16K 5/0605 122/13.3
7,881,593 B2 * 2/2011 Grassi ..... F24C 3/126 99/279
7,947,932 B2 * 5/2011 Sherrill ..... H05B 3/06 219/532
7,959,090 B2 * 6/2011 Shank ..... F24H 1/202 392/480
7,972,077 B2 * 7/2011 Kim ..... E04F 11/1844 403/375
8,104,434 B2 * 1/2012 Fabrizio ..... F24H 9/2028 392/485
8,165,461 B2 * 4/2012 Sullivan ..... H05B 3/78 392/494
8,280,236 B2 10/2012 Fabrizio
8,304,699 B2 11/2012 Fliess et al.
8,426,779 B2 * 4/2013 Schlipf ..... H05B 3/48 219/628
8,577,211 B2 11/2013 Lucker et al.
9,234,674 B2 1/2016 Hayden et al.
10,139,136 B2 11/2018 Hayden et al.
10,914,492 B2 2/2021 Hayden et al.
2002/0008970 A1 * 1/2002 Hanson ..... F21L 15/04 362/186
2002/0186966 A1 * 12/2002 Zimmer ..... F17C 13/026 392/397
2003/0026603 A1 * 2/2003 Castaneda ..... F24H 1/142 392/483
2004/0051313 A1 * 3/2004 Trouyet ..... F16L 37/0885 285/305
2004/0069517 A1 * 4/2004 Olson ..... H02G 3/06 174/481
2004/0098831 A1 * 5/2004 Elmer ..... E05D 15/063 16/89

(56) References Cited

U.S. PATENT DOCUMENTS

2004/0099652 A1* 5/2004 Berkcan ..... H05B 3/746 219/448.11
2005/0072103 A1* 4/2005 Hopwood ..... E04C 5/165 52/633
2006/0000824 A1* 1/2006 Howard ..... H05B 3/16 219/536
2006/0168756 A1* 8/2006 Sato ..... G06F 1/1681 16/22
2006/0215178 A1* 9/2006 Seko ..... G01B 11/002 356/614
2006/0222349 A1* 10/2006 Sturm ..... F24H 9/2028 392/463
2007/0017265 A1* 1/2007 Andersson ..... E05B 47/0692 70/379 R
2007/0027265 A1 1/2007 Andersson
2007/0023418 A1* 2/2007 Schlipf ..... H05B 3/04 219/532
2008/0028512 A1* 2/2008 Hughson ..... F24H 9/2028 4/541.3
2008/0152331 A1 6/2008 Ryks
2008/0274823 A1* 11/2008 Lindner ..... A63B 60/00 473/297
2009/0025399 A1* 1/2009 Kamen ..... B01D 5/0012 165/184
2009/0034947 A1* 2/2009 Tsai ..... H05B 3/44 392/407
2009/0116826 A1* 5/2009 Evans ..... F24H 1/102 392/478
2010/0004790 A1* 1/2010 Harbin, III ..... F24D 19/1051 709/219
2010/0068123 A1* 3/2010 Edwin ..... C01B 32/05 423/447.2
2010/0086289 A1* 4/2010 Johnson ..... F24H 1/142 219/482
2010/0093205 A1* 4/2010 Stone ..... H01R 13/5219 439/352
2010/0126108 A1* 5/2010 Andrikopoulos ..... F16B 7/044 403/171
2010/0195991 A1 8/2010 Deivasigamani et al.
2010/0212752 A1* 8/2010 Fima ..... F24H 9/2007 137/87.03
2011/0147552 A1* 6/2011 Hazzard ..... F24H 9/1836 248/222.14
2011/0203781 A1* 8/2011 Ellingwood ..... F24H 1/403 165/173
2011/0233191 A1* 9/2011 Gubler ..... H05B 3/46 219/546
2011/0240269 A1* 10/2011 Mackenzie ..... F28F 9/26 165/141
2011/0318090 A1* 12/2011 Lai ..... B25B 13/56 403/27
2012/0055917 A1* 3/2012 Kimmins ..... F24H 1/202 219/553
2012/0063755 A1* 3/2012 Lucker ..... F24H 9/2028 392/470
2012/0141100 A1* 6/2012 Evans ..... H05B 3/42 392/485
2012/0237191 A1* 9/2012 Clark ..... F24H 9/2028 392/454
2012/0275775 A1* 11/2012 Iskrenovic ..... F24H 9/14 392/483
2013/0034344 A1* 2/2013 Lutz ..... F24H 9/2028 392/449
2013/0156492 A1* 6/2013 Maier ..... B62J 1/08 403/109.1
2014/0023352 A1* 1/2014 Jurczyszak ..... F24H 1/08 392/465
2014/0023354 A1* 1/2014 Hankins ..... F24H 1/103 392/480
2014/0178057 A1* 6/2014 Hayden ..... F24H 1/142 392/480

OTHER PUBLICATIONS

International Written Opinion dated Jun. 5, 2013 in PCT/US2013/032298, filed Mar. 15, 2013.
International Search Report dated Jan. 3, 2014 in PCT/US2013/050897, dated Jul. 17, 2013.
Written Opinion dated Jan. 3, 2014 for PCT/US2013/050897, dated Jul. 17, 2013.

* cited by examiner

NEXT GENERATION BARE WIRE WATER HEATER

CROSS REFERENCE TO RELATED APPLICATIONS

This Application is a continuation application of U.S. application Ser. No. 16/162,763 filed Oct. 17, 2018, now U.S. Pat. No. 10,914,492, which is a continuation application of U.S. application Ser. No. 14/951,001 filed Nov. 24, 2015, now U.S. Pat. No. 10,139,136, which is a continuation application of U.S. application Ser. No. 13/835,346 filed Mar. 15, 2013, now U.S. Pat. No. 9,234,674, which is based upon and claims benefit of priority from U.S. Provisional Application No. 61/740,653, filed on Dec. 21, 2012, the entire contents of each of which are incorporated herein by reference.

BACKGROUND

There are a variety of methods for heating fluid. One method involves the user of an electrically charged bare wire to heat fluids passing over the bare wire. As fluid in this method is passed directly over the bare wire itself, the water is heated at an extremely high rate. However, bare wire elements are susceptible to damage when dry fired or operated under low pressure. In other words, fluid must be continually present and flowing using bare wires systems as the presence of air gaps or stagnant water for a period of time can damage the bare wire and associated heating system due to overheating.

To detect overheating, many systems use mechanical thermostats to identify the temperature inside of a heating chamber. However, this approach is limited by the time it takes for heat to transfer through all materials within the heating system especially with the presence of stagnant water or gas pockets. This lengthened reaction time significantly increases the chances of damage to the heating unit and instability to the system as a whole.

SUMMARY OF ILLUSTRATIVE EMBODIMENTS

A heating unit for heating fluid is described having at least one electrical resistance heating element on an outer surface of a tube. At least one indexed groove is provided around a surface of the tube allowing for at least one retention clip to hold the electrical resistance heating element. A heating chamber is also provided to enclose a portion of the tube and to provide a flow channel therebetween. The heating chamber includes an optical sensor to detect overheating of the at least one electrical resistance heating element. Fluid is heated by flowing over the surface of the at least one electrical resistance heating element and through the tube.

The details of one or more implementations are set forth in the accompanying drawing and description below. Other features, objects, and advantages will be apparent from the description and drawings, and from the claims.

BRIEF DESCRIPTION OF FIGURES

Like reference symbols in various drawing indicate like elements.

DETAILED DESCRIPTION OF THE ILLUSTRATIVE EMBODIMENTS

Figures 1A, 1B, 1C:
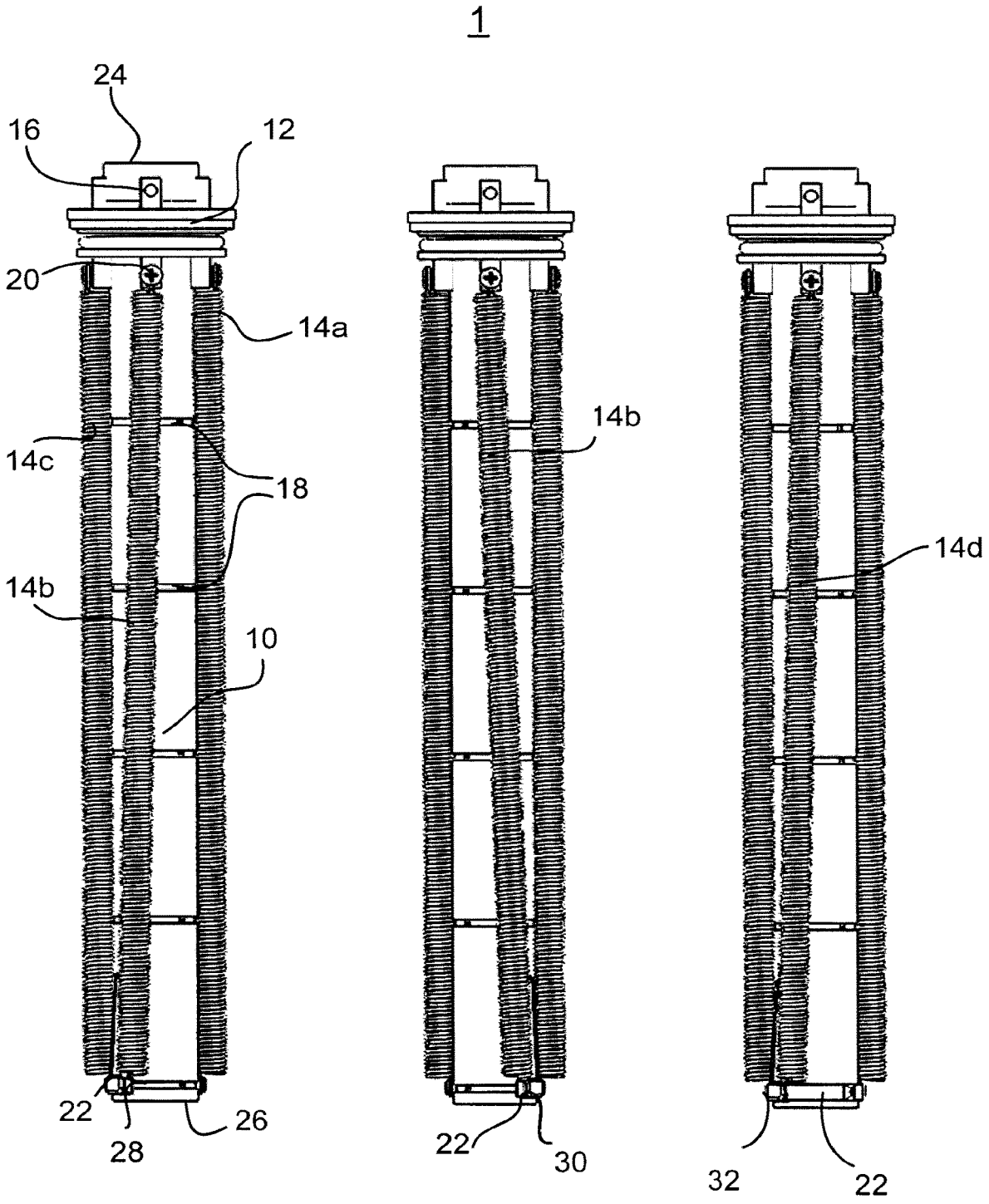
FIG. 1A is a side view of a heating unit according to one example.
FIG. 1B is a side view of the heating unit according to one example.
FIG. 1C is a side view of the heating unit according to one example.

Selected embodiments are now described by referring now to the drawings, wherein like reference numerals designate identical or corresponding parts throughout the several views. It is noted that as used in the specification and the appending claims, the singular forms "a," "an," and "the" can include plural references unless the context clearly dictates otherwise.

FIGS. 1A-1C illustrate a heating unit 1 according to an exemplary embodiment. In FIG. 1A, the heating unit 1 includes a tube 10 having a cylindrical shape with a flange 12 at one end. The flange 12 provides a connection point to external components with respect to an outlet 24 of the tube. The tube 10 is molded or machined to have at least one indexed groove 18 around a circumference of the tube 10. The at least one indexed groove 18 is a recess provided in the tube 10 which runs continuously around the circumference of the tube 10. In selected embodiments, the tube 10 will have a plurality of any number of indexed grooves 18 located at predetermined intervals along the body of the tube 10 with respect to a length of the tube 10 as illustrated in FIGS. 1A-1C. The indexed grooves 18 may be machined or molded at equal distances from each other based on the length of the tube 10 or may be machined or molded at preset positions along the length of the tube 10. Additionally, the tube 10 has an inlet 26 through which fluids may be transmitted through the tube 10.

The tube 10 is molded or machined to act as a supporting structure for at least one electrical resistance heating element 14 which runs the length of the tube 10. In selected embodiments and as illustrated in FIGS. 1A-1C, the heating unit 1 may comprise a plurality of electrical resistance heating elements 14*a*-14*d*. Each electrical resistance heating element 14 is mechanically connected to the tube 10 via a termination connector 16 which extends through the flange 12 and at least one retention clip 22 provided on one of the indexed grooves 18. The termination connector 16 includes at least one hole so that a fastening device 20, such as a screw, can be used to affix the electrical resistance heating element 14 to the tube 10. In selected embodiments, the termination connector 16 may be a single component or two separate components attached to either side of the flange 12.

Electricity is externally applied to the electrical resistance heating elements 14 from an external source, such as an electrical circuit, via the termination connector 16. In selected embodiments and as illustrated in FIGS. 1A-1C, the heating unit 1 will include a single retention clip 22 to which one or more of the electrical resistance heating elements 14 are connected. However, multiple retention clips 22 can be provided within one or more of the indexed grooves 18 thereby providing multiple connection points for one or more electrical resistance heating elements 14. Further, retention clip 22 can be molded or machined as part of the tube 10 or can be a separate component which is removable from the tube 10.

The retention clips 22 are formed to provide pivot points for the electrical resistance heating elements 14 connected thereto. In other words, the retention clips 22 can be linearly adjusted along the indexed grooves 18 at which the retention clip is located to linearly adjust the location of the placement of the electrical resistance heating elements 14 on the surface of the tube 10. For example, in FIG. 1A, the electrical resistance heating element 14*b* is illustrated as connected to the retention clip 22 at a first position 28 along the bottom of the tube 10. The first position 28 is determined based on the adjustment of the retention clip 22 within the indexed groove 18. In FIG. 1B, however, it can be seen that the electrical resistance heating element 14*b* is located at a second position 30 based on the linear adjustment of the retention clip 22 within the indexed groove 18. Further, FIG. 1C illustrates the opposite side of the tube 10 with respect to FIGS. 1A and 1B and illustrates a first position 32 of the electrical resistance heating element 14*d* at the bottom of the tube 10 based on the linear adjustment of the retention clip 22.

The ability to linearly adjust the electrical resistance heating elements 14 within an indexed groove 18 via the retention clip provides numerous advantageous. For example, each system in which the heating unit 1 is applied can be tested to determine the best heat transfer properties based on the particularities of the system such that the position of the electrical resistance heating elements 14 can be adjusted to maximize heat transfer within that system. Further, should the heat transfer characteristics change at some point, the locations of the electrical resistance heating elements 14 of the heating unit 1 can easily be modified to compensate for this change.

Figure 2A:
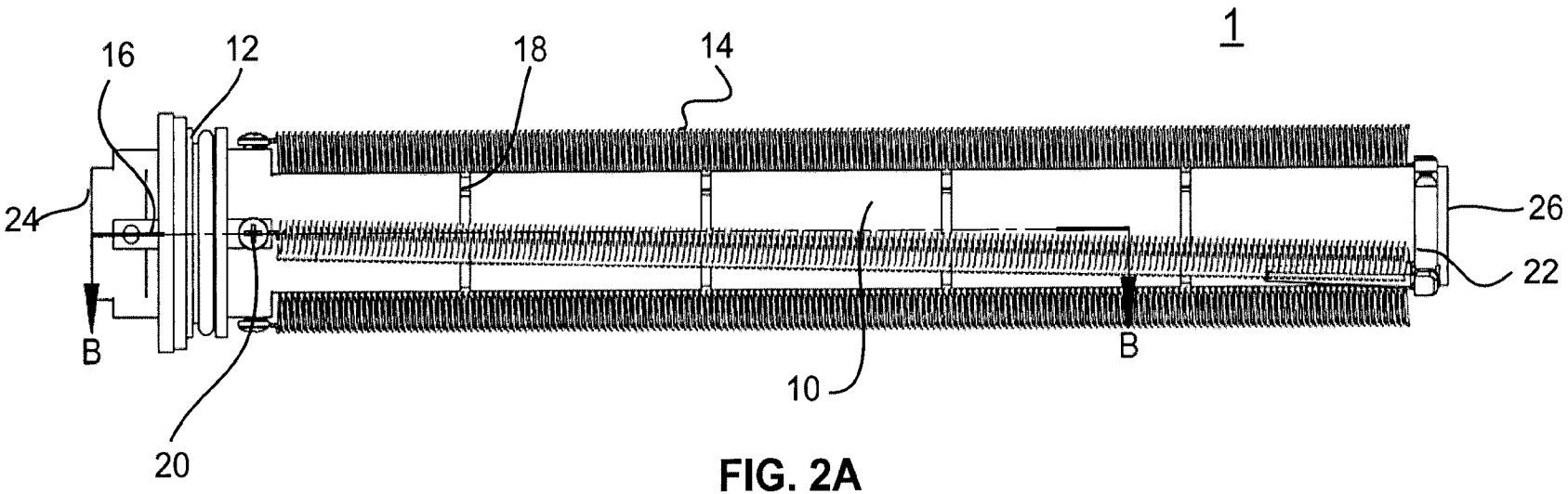
FIG. 2A is a side view of the heating unit identifying a cross-section according to one example.
Figure 2B:
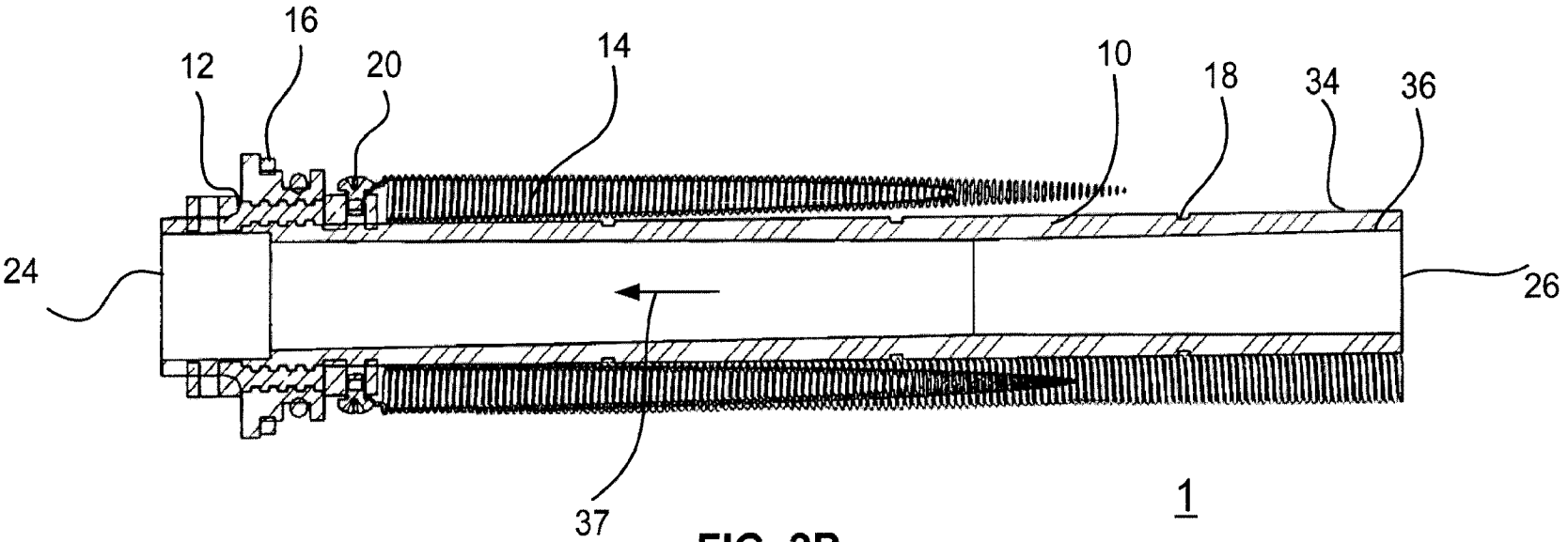
FIG. 2B is a cross-sectional view of the heating unit of FIG. 3A according to one example.

FIG. 2A illustrates a side view of the heating unit 1 according to an exemplary embodiment. Like designations are repeated and therefore the heating unit 1 provides a tube 10 having an inlet 26 and an outlet 24. The heating unit 1 further includes a flange 12, termination connection 16, indexed grooves 18, a retention clip 22 and electrical resistance heating elements 14. FIG. 2B illustrates a cross sectional view of the heating unit 1 of FIG. 2A cut across the segment "B" illustrated in FIG. 2A.

As illustrated in FIG. 2B, the heating unit 1 has a termination connector 16, flange 12, fastening device 20 and electrical resistance heating elements 14. FIG. 2B also clearly illustrates the indexed grooves 18 running around a circumference of an outer surface of the tube 10. As previously described herein, the indexed grooves 18 are recesses in an outer surface of the tube 10. The depth of the recesses of the indexed grooves 18 can be any amount of displacement from the outer surface 34 of the tube 10 to an inner surface 36 of the tube 10. As illustrated in FIG. 2B, the indexed grooves 18 are machined or molded in a straight circular continuous fashion around the circumference of the tube 10. However, in other selected embodiments, the indexed grooves 18 may be machined or molded in different shapes around the circumference of the tube 10 such that the retention clip 22 can be adjusted in various directions with respect to the length of the tube 10. Further, in selected embodiments, the tube 10 may be machined or molded to contain different combinations of the above-described indexed grooves 18. FIG. 2B also illustrates a fluid flow path 37 through which fluids flow from the inlet 26 through the tube 10 to the outlet 24. The fluid flowing into the tube 10 is fluid that has been heated by flowing over the electrical resistance heating elements 14 and/or fluid that is heated by passing through the tube 10 which is heated from the exterior by the electrical resistance heating elements 14.

Figure 3B:
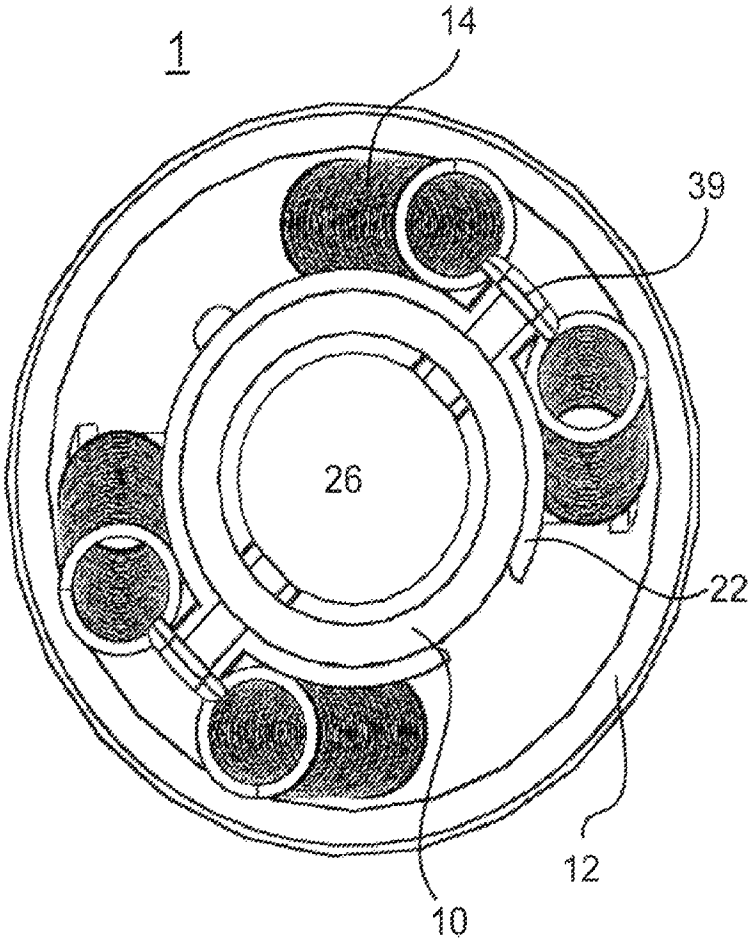
FIG. 3B is a bottom view of the heating unit according to one example.
Figure 3A:
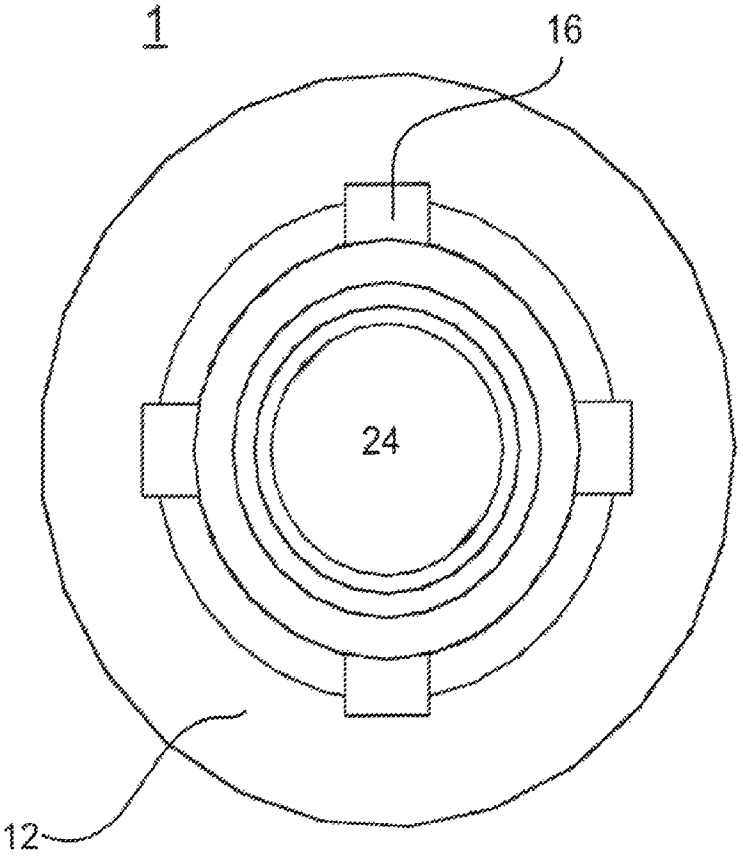
FIG. 3A is a top view of the heating unit according to one example.

FIG. 3A illustrates a top view of the heating unit 1 according to an exemplary embodiment. As illustrated in FIG. 3A, there is a top view of the flange 12 having the plurality of termination connections 16 for mechanically and electrically attaching each respective electrical resistance heating element 14. FIG. 3A further illustrates an exemplary fluid flow direction coming out of the tube 10 via outlet 24. FIG. 3B illustrates a bottom view of the heating element according to an exemplary embodiment. As illustrated in FIG. 3B, there is a bottom view of the flange 12 and the tube 10. A plurality of electrical resistance heating elements 14 are attached to the retention clip 22 which is placed over and/or within an indexed groove 18 (not visible due to angle) of the tube 10. In selected embodiments, the electrical resistance heating elements 14 are attached to the retention clip 22 via at least one hook 39 of the retention clip 22. The hook 39 may in selected embodiments be covered with a shielding element in order to prevent damage from heat emanating from connected electrical resistance heating elements 14. As the retention clip 22 is removable in selected embodiments, the retention clip 22 is not required to fully extend around the circumference of the tube 10. However, in selected embodiments the retention clip 22 may fully extend around the tube 10. FIG. 3B also illustrates an exemplary fluid flow direction going into the tube via inlet 26.

Figure 4A:
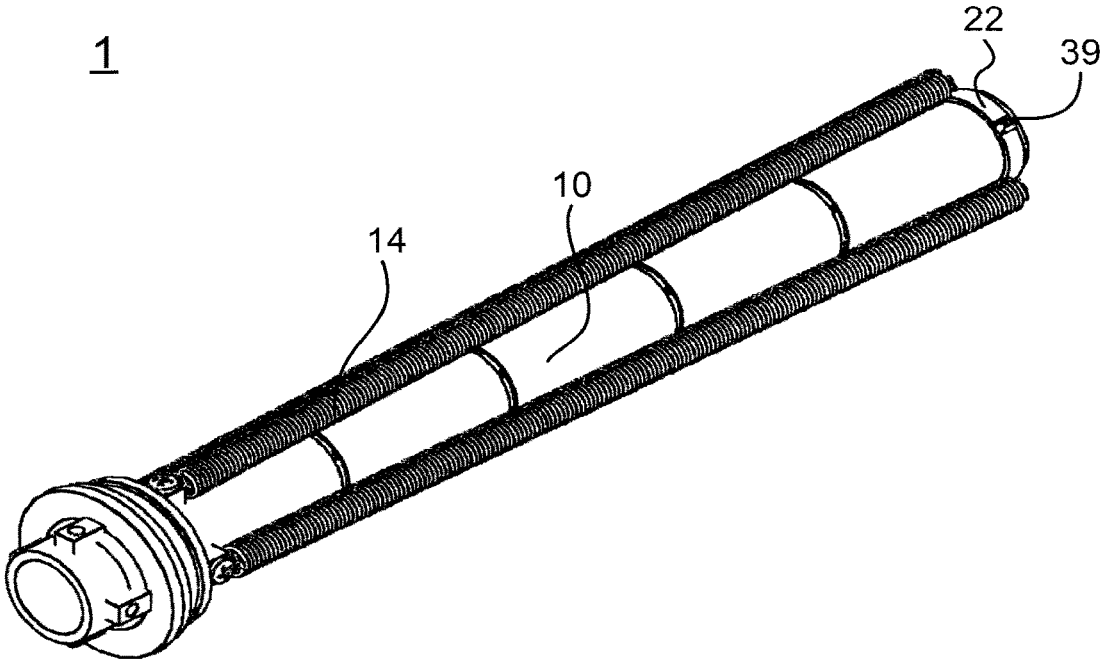
FIG. 4A is a perspective view of the heating unit according to one example.
Figure 4B:
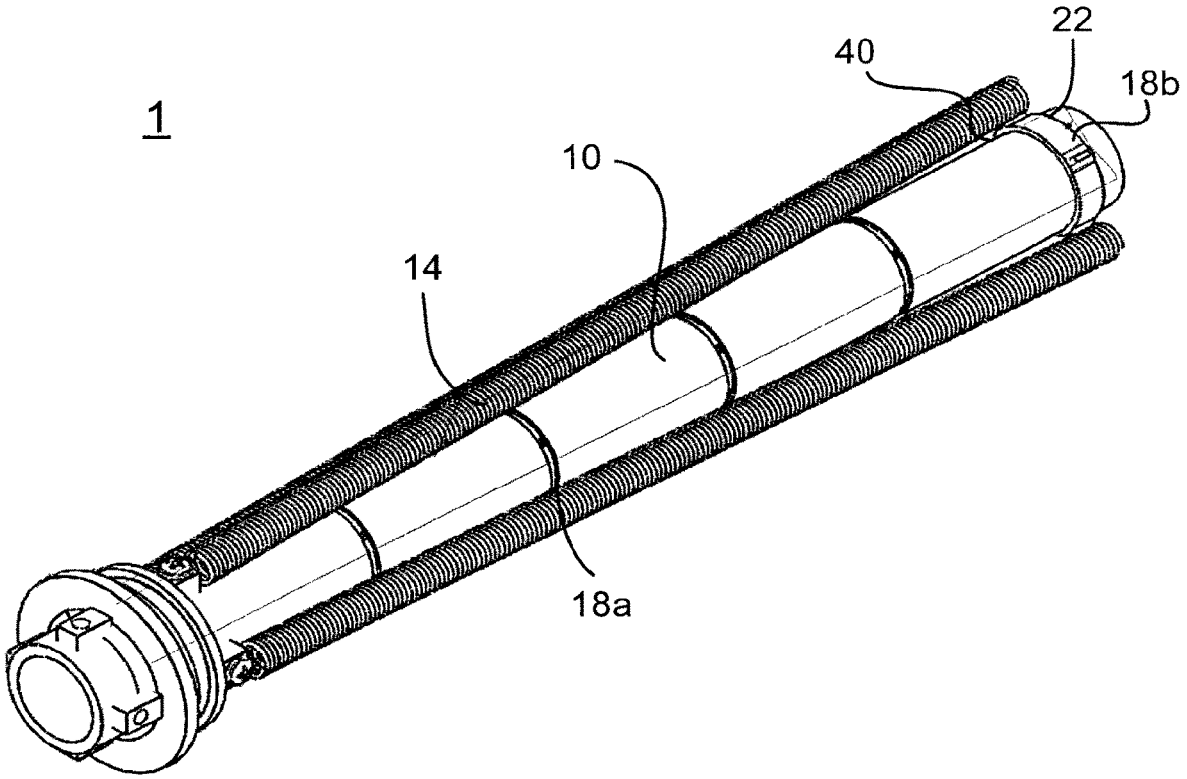
FIG. 4B is a perspective view of the heating unit according to one example.

FIG. 4A illustrates a perspective view of the heating unit 1 according to an exemplary embodiment. In FIG. 4A, it can be seen that the electrical resistance heating elements 14 are positioned along a length of the surface of the tube 10 up until a connection with the retention clip 22. Therefore, as illustrated in FIG. 2B, the electrical resistance heating elements 14 are positioned on the surface of the tube 10. However, alternatively or in addition to, electrical resistance heating elements 14 may be suspended away from the surface of the tube by using the retention clip 22 as a support structure as illustrated in FIG. 4B. In this instance, the electrical resistance heating element 14 is attached to the retention clip 22 via the hook 39 raised from a surface of the retention clip 22. Accordingly, as illustrated in FIG. 4B, by using the retention clip 22 as a support structure, there is a gap 40 between a surface of the tube 10 and a surface of the electrical resistance heating element 14. Further, in selected embodiments, each electrical resistance heating element 14 can be raised off a surface of the tube 10 by using the retention clip 22 as support structure in a similar fashion. Further, additional retention clips 22 may be provided at various indexed grooves 18 thereby providing for gaps between the surface of the tube 10 and a surface of the electrical resistance heating elements 14 at various locations along the length of the tube 10. For example, in selected embodiments, a first retention clip (not shown) could be provided at a first indexed groove 18*a* and the retention slip 22 could be placed at a second indexed groove 18*b* (as illustrated) thereby raising an entirety of the electrical resistance heating element 14 off the surface of the tube 10 and providing a large gap for enhanced fluid flow therebetween.

The use of retention clips 22 as a support structures to provide a gap between a surface of the tube 10 and the surface of the electrical resistance heating elements 14 provides various advantages. For instance, by using the retention clips in this fashion, there will be an increased fluid flow over the electrical resistance heating elements 14 thereby providing an enhanced cooling effect that lowers the risk of burnout or damage to the electrical resistance heating elements 14. Further, connecting the electrical resistance heating elements 14 to the retention clip 22 in this fashion provides for a predetermined amount of tension of the electrical resistance heating elements 14 thereby preventing sag or looseness of the electrical resistance heating elements 14. Alternatively, or in addition, the indexed grooves 18 themselves could be molded or machined such that they are raised above the surface of the tube 10 thereby providing a support structure on which to raise the electrical resistance heating elements 14 above a surface of the tube 10. Retention clips 22 could then be used on the raised indexed grooves 18 to adjust the position of the electrical resistance heating elements 14 as previously described herein.

Figure 5B:
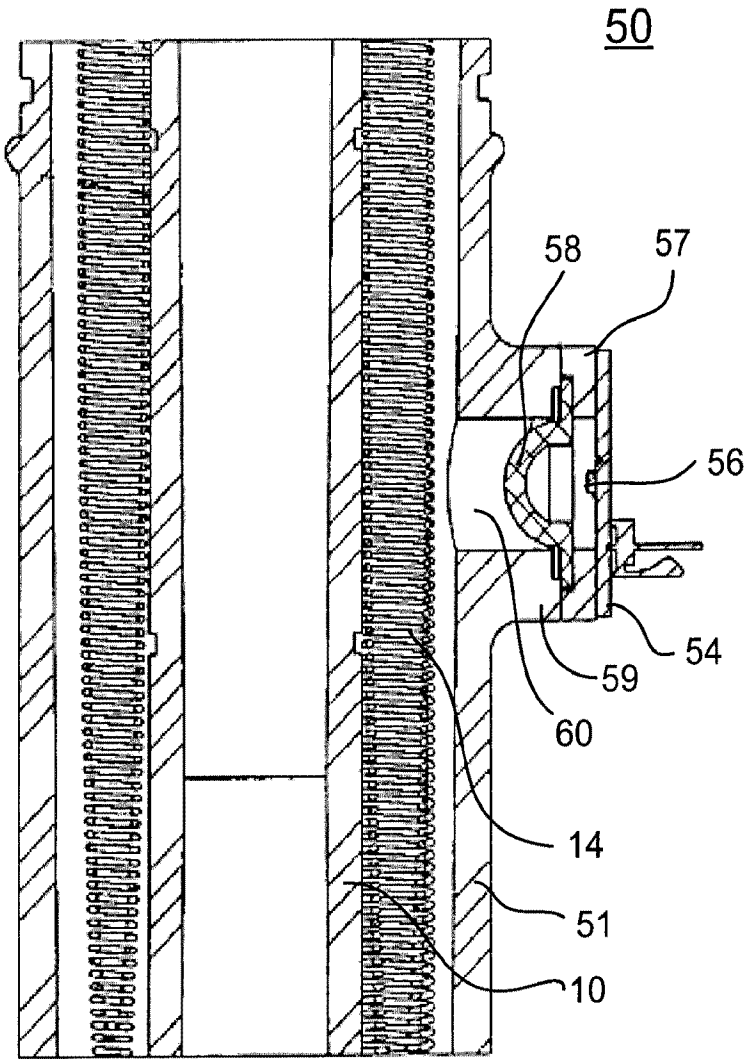
FIG. 5B is a cross sectional view of the heating chamber of FIG. 5A having an optical assembly according to one example.
Figure 5A:
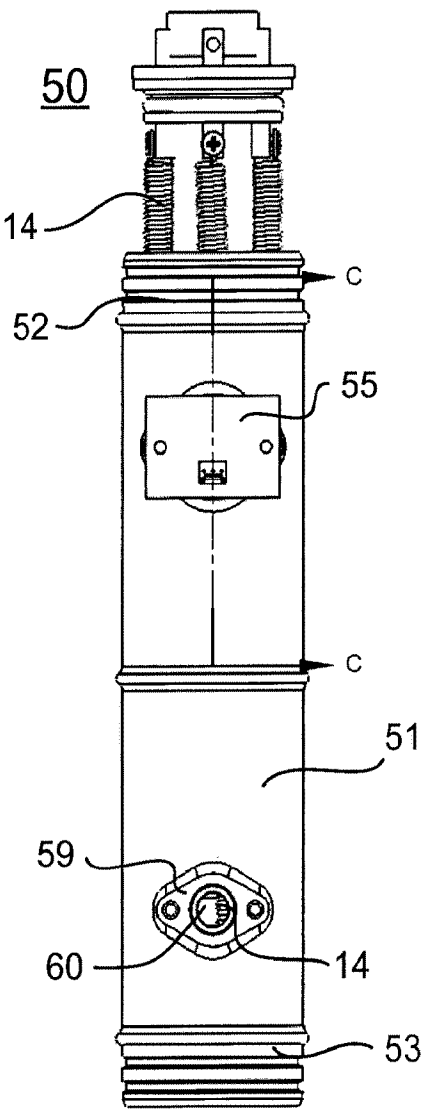
FIG. 5A is a side view of a heating chamber in relation to the heating unit according to one example.

FIG. 5A illustrates a heating system 50 comprising a heating chamber 51 that partially encloses the heating unit 1 according to an exemplary embodiment. As illustrated in FIG. 5A, the heating chamber 51 includes a first connecting portion 52 for connecting to external components. The heating chamber 51 also includes a second connecting portion 53 for connecting to other parts external to the heating system 50. The heating chamber 51 further includes at least one connection port 59 having an opening 60 through which at least one electric resistive heating elements 14 is visible. In other words, the heating chamber 51 is molded or machined such that it includes at least one opening 60 to the components of the heating unit 1 when the heating unit is enclosed by the heating chamber 51. FIG. 5A further illustrates an optical assembly 55 affixed to the opening 60 of the connection port 59. It is noted that in selected embodiments, the heating chamber 51 may include a plurality of connection ports 59 having corresponding openings 60 as well as one or more corresponding optical assemblies 55.

FIG. 5B illustrates a cross sectional view of the heating system 50 along a cross section cut identified by the letter "C" in FIG. 5A. In FIG. 5B, the connection port 59 provides an opening 60 within the surface of the heating chamber 51 such that the electrical resistance heating element 14 located at or near that position is visible via the opening 60. The optical assembly 55 comprises at least a backplane 54 having at least one optical sensor 56 attached thereto, a light blocking element 57 and a translucent filter 58. As illustrated in FIG. 5B, the translucent filter 58 is provided over the opening 60 of the connection port 59. The light blocking element 57 is provided over the translucent filter 58 and the backplane 54 is provided over the light blocking element 57 with the at least one optical sensor 56 of the backplane being placed on a side facing the light blocking element 57, translucent filter 58 and opening 60.

Figure 6:
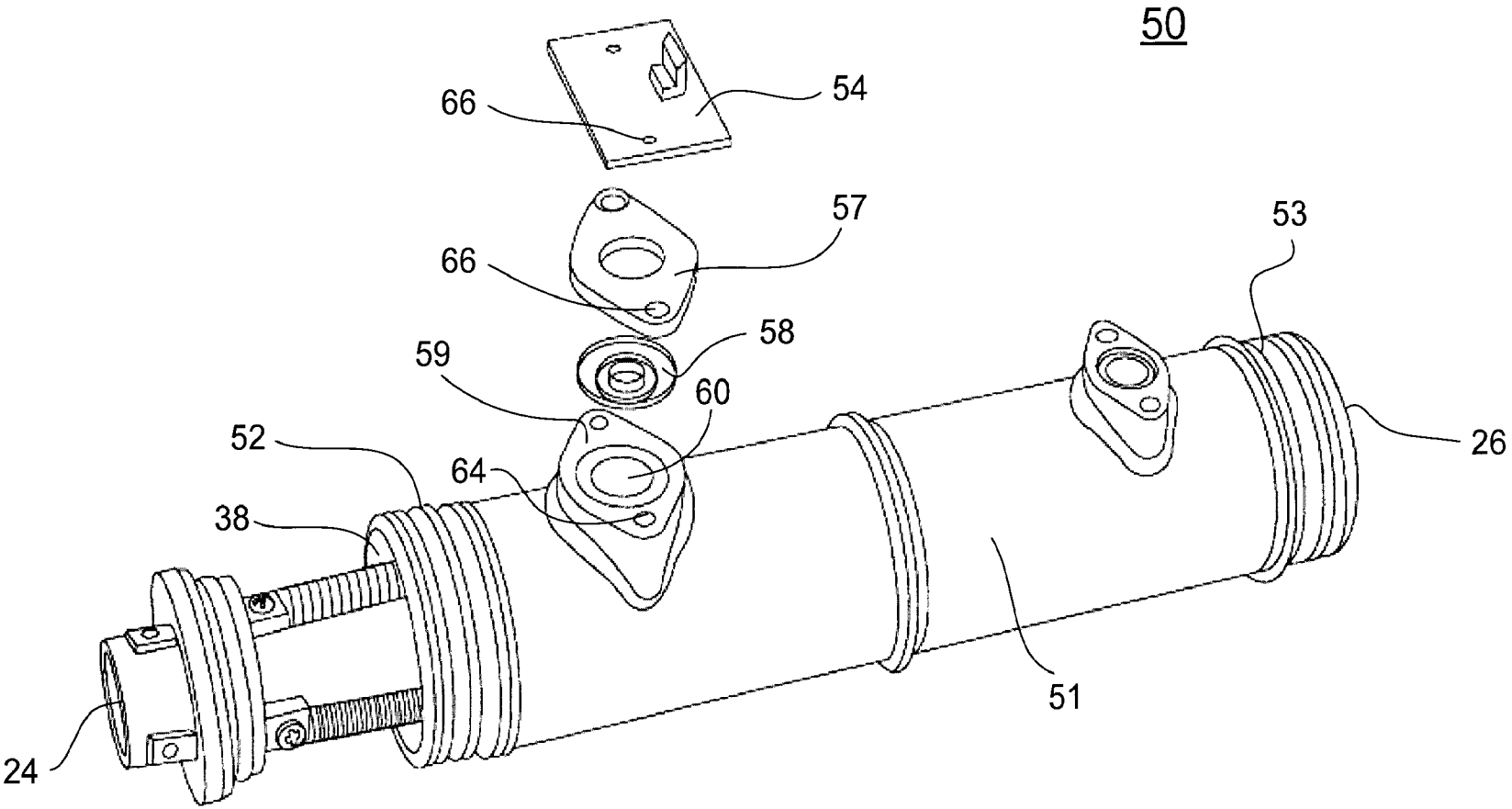
FIG. 6 is a three-dimensional view of the formation of the optical assembly on the heating chamber according to one example.

FIG. 6 illustrates a method of assembly of the system 50 and optical assembly 55 over a connection port 59 of the heating chamber 51. As illustrated in FIG. 6, the heating unit 1 having electrical resistance heating elements 14 is partially enclosed within the heating chamber 51 such that there is provided a flow channel 38 over the electrical resistance heating elements 14 between the tube 10 and heating chamber 51. In selected embodiments, liquid flow is externally directed into the flow channel 38 such that the liquid flows towards the inlet 26. The liquid is then externally directed into the inlet 26 through the tube 10 and out the outlet 24. Accordingly, liquids are efficiently heated by being energized both while flowing over the electrical resistance heating elements 14 and while flowing through the tube 10. In selected embodiments, the heating chamber 51 may fully enclose the heating unit 1 except for at the inlet 26 end such that fluid may come into the heating chamber 51 via the area surrounding the inlet 26 such that flow is directed around the electrical resistance heating elements 14 and into the inlet 26.

A plurality of connection ports are also illustrated in FIG. 6. Connection port 59 having an opening 60 is raised above an outer surface of the heating chamber 51. However, in selected embodiments, the connection port 59 may be flush with the outer surface of the heating chamber 51. The translucent filter 58 is placed over all or a portion of the connection port 59 and fully covers the opening 60. The translucent filter 58 is illustrated in FIG. 6 having a concave shape but can take any shape as would be recognized by one of ordinary skill in the art. The light blocking element 57 is then positioned over the translucent filter 58 as well as the connection port 59. The back plane 54 is then positioned over the light blocking element 57. As the optical sensor 56 is on a side of the backplane 54 facing the opening 60, the optical sensor 56 is on the lower side of the backplane 54 and is not visible in FIG. 6. At least one fastener location 64 is also provided within the connection port 59 such that corresponding fastening locations 66 of the light blocking element 57 and backplane 54 can be firmly affixed to the heating chamber 51.

The optical assembly 55 provides the heating system 50 with the ability to efficiently detect overheating of the electrical resistance heating elements 14. Under normal conditions, the electrical resistance heating elements 14 will not emit any visible light and will only emit heat energy. However, if at least one of the electrical resistance heating elements 14 is dry fired without the presence of a fluid or has been energizing stagnant fluids for extended periods, the electrical resistance heating element 14 will begin to emit light energy in the visible spectrum. For example, the electrical resistance heating element 14 may begin in this instance to emit a visible red, orange or yellowish glow. The optical sensor 56 is an optical sensor as would be recognized by one of ordinary skill in the art and is calibrated, selected and/or filtered such that the optical sensor 56 will detect light emitted from one or more overheating electrical resistance heating element 14. To reduce the amount of non-visible infrared emission from one or more of the electrical resistance heating elements 14 which could cause false readings by the optical sensor 56, at least one translucent filter 58 is provided as described herein which filters the infrared emission before it is detected by the optical sensor 56.

To prevent further false readings by the optical sensor 56, the light blocking element 57 is provided over a portion of the translucent filter 58 to prevent ambient light from entering the opening 60 of the heating chamber 51 between the heating chamber 51 and the translucent filter 57 and/or the translucent filter 57 and the backplane 54. Further, in selected embodiments, the heating chamber 51 may be molded or machined from an opaque material to further reduce the amount of ambient light that may enter an inner surface of the heating chamber 51. Additionally, in selected embodiments, the backplane 54 may consist of Printed Circuit Board (PCB) made of an opaque material to prevent ambient light from entering a backside of the PCB and affecting readings made by the optical sensor 56. Power is provided to the optical sensor 56 via the backplane 54 which is powered from an external source as would be understood by one of ordinary skill in the art.

The heating system 50 described above having a heating chamber 51 comprising an optical assembly 55 which can detect overheating of electrical resistance heating elements 14 of the enclosed heating unit 1 provides numerous advantages. At any point at which the optical sensor 56 detects visible light being emitted from at least one of the electrical resistance heating elements 14, a signal may be generated by the optical sensor 56 and processed by the PCB to transmit a signal to cut power to a specific overheating electrical resistance heading element 14 or to all the electrical resistance heating elements. Signals output from the optical sensor 56 may also be further filtered by software or hardware to ignore ambient light from external sources and limit detection and warning to light emitted by the electrical resistance heating elements 14 in a particular visible spectrum. Further, detecting overheating via the optical sensor 56 through the detection of light provides extremely high speed of light reaction times for shutting down one or more electrical resistance heating elements 14. Therefore, the heating system 50 can easily prevent damage to the electrical resistance heating elements 14 or other parts thereby increasing the longevity of the system as a whole and reducing cost for replacement parts.

It should be noted that while the description above with respect to FIGS. 1-6 describes various features of the heating unit 1 and heating system 50, numerous modifications and variations are possible in light of the above teachings. For example, each electrical resistance heating element 14 can be provided a different length and connected to the tube via a retention clip 22 at an indexed groove 18 different from that of other electrical resistance heating elements 14. Alternatively, each electrical resistance heating element 14 can be of a shorter length than that illustrated in FIGS. 1A-1C and attached to the same retention clip 22 at an indexed groove 18 closer to the flange 12. This allows the use of the same tube 10 to provide various configurations based on individual client needs, to provide optimized configurations for heat transfer based on particularities of various systems and to provide a "one size fits all" to lower production costs. Further, systems requiring less heat may employ fewer electrical resistance heating elements 14 whereas systems requiring more heat may employ additional electrical resistance heating elements.

Additional configurations are possible via design options for the heating chamber 51 such that the heating chamber 51 may be machined or molded with one or more connection ports 59 and openings 60. Accordingly, the heating chamber 51 may have connection ports 59 on various sides of the heating chamber 51 such that a plurality of electrical resistance heating elements 14 are visible through openings 60. Accordingly, a plurality of optical assemblies 55 may be affixed to the connection ports 59 to provide enhanced thermal detection and safety activation procedures to reduce the chances of damage to the electrical resistance heating elements 14. To provide the heating system 50 at a lower cost, fewer optical assemblies 55 may be used to detect light emitted from one or more electrical resistance heating elements 14. In this configuration, the optical sensor 56 may be configured to detect lower level amounts of visible light such that light emitted by overheating electrical resistance heating elements 14 on the opposite side of the connection port 59 of which the optical assembly 55 is attached may be detected. Further, in selected embodiments reflective optics may be placed on the outer surface of the tube 10 and/or an inner surface of the heating chamber 51 such that light emitted by overheating electrical resistance heating elements 14 is transmitted through the interior of the heating system 51 and/or magnified for enhanced detection by the optical sensor 56. In this configuration, cost may be saved as fewer optical assemblies may be required.

The components described above can be manufactured, in selected embodiments, via injection molding or machining as would be understood by one of ordinary skill in the art. Therefore, the tube 10 and heating chamber 51 may be molded into any shape or made from any material, such as thermoplastic or thermosetting polymers, as would be understood by one of ordinary skill in the art. Accordingly, common polymers such as epoxy, phenolic, nylon, polyethylene or polystyrene may be utilized. This material is fed into a heated barrel, mixed and forced into a mold cavity (formed of a material such as steel or aluminum and machined to a form that features the desired part) where it cools and hardens to the configuration of the cavity. Exemplary molding machines that may be utilized for such a process include a Ferromatik milcaron injection molding machine or those built by Arburg.

The components described above, such as the heating unit 1 and heating chamber 51, may be also be precision machined manually or automatically by computer numerical control (CNC) as would be understood by one of ordinary skill in the art. Accordingly, the components can be formed of metal, such as steel or aluminum, and formed via a combination of turning, drilling, milling, shaping, planning, boring, broaching and sawing.

The electrical resistance heating elements 14 can be made from any type of alloy as would be understood by one of ordinary skill in the art. For example, the electrical resistance heating elements 14 may consist of a high temperature resistance alloy such as nickel-chrome alloy or iron chrome aluminum alloy. These may be formed as coils as illustrated in FIGS. 1-6 or may be looped or sinuously wound around the tube 10. The electrical resistance heating elements 14 may be one continuous element, separate elements and sheathed or sheathless.

The optical sensor 56 in selected embodiments may be any electro-optical sensor as would be recognized by one of ordinary skill in the art. The optical sensor measures the physical quantity of light rays and converts this information into electronic signals which are process by the PCB. The translucent filter 57 may be any filter that can block infrared wavelengths but pass visible light as would be understood by one of ordinary skill in the art. For instance, the translucent filter may be an infrared cut-off filter or heat-absorbing filter which reflects or blocks infrared wavelengths while passing visible light.

Obviously, numerous modifications and variations of the present advancements are possible in light of the above teachings. It is therefore to be understood that within the scope of the appended claims, the present advancements may be practiced otherwise than as specifically described herein.

The invention claimed is:

1. A heating unit comprising:

a tubular body having a first end and a second end, the tubular body comprising:

a fluid inlet;

a fluid outlet;

a flange proximate the first end; and an attachment groove formed into an external surface of the tubular body;

an attachment device attachable to the tubular body at the attachment groove; and an electrical resistance heating element having a first end and a second end, the first end of the electrical resistance heating element being attached about the external surface of the tubular body proximate the first end of the tubular body and the second end of the electrical resistance heating element being attached to the attachment device, wherein the heating unit is configured to heat a fluid flowing over a surface of the electrical resistance heating element and through the tubular body.

2. The heating unit of claim 1, wherein the attachment device is attachable at a plurality of locations along the attachment groove.

3. The heating unit of claim 1, wherein:

the attachment groove is a first attachment groove located at a first location along a length of the tubular body, the body comprises a second attachment groove located at a second location along the length of the tubular body, and the attachment device is configured to attach to the tubular body at either the first attachment groove or the second attachment groove.

4. The heating unit of claim 1, wherein the electrical resistance heating element is one of a plurality of electrical resistance heating elements, each of the plurality of electrical resistance heating elements having a first end attached to the tubular body proximate the first end of the tubular body and a second end attached to the attachment device.

5. The heating unit of claim 1, wherein the tubular body has an elongate shape extending from the fluid inlet to the fluid outlet.

6. The heating unit of claim 1, wherein the attachment device is a clip and is detachably attachable to the tubular body.

7. The heating unit of claim 1, wherein the electrical resistance heating element comprises an alloy in the form of a coil.

8. A heating device comprising:

a heating unit comprising:

a tubular body having a first end and a second end, the tubular body comprising:

a fluid inlet;

a fluid outlet;

a flange proximate the first end; and an attachment groove formed into an external surface of the tubular body;

an attachment device attachable to the tubular body at the attachment groove;

an electrical resistance heating element having a first end and a second end, the first end of the electrical resistance heating element being attached to the tubular body proximate the first end of the tubular body and the second end of the electrical resistance heating element being attached to the attachment device; and a heating chamber in which the heating unit is at least partially disposed to define a gap between the tubular body and an interior wall of the heating chamber, wherein the heating device is configured to heat a fluid flowing through the gap and over a surface of the electrical resistance heating element and through the tubular body.

9. The heating device of claim 8, wherein the attachment device is attachable at a plurality of locations along the attachment groove.

10. The heating device of claim 8, wherein:

the attachment groove is a first attachment groove located at a first location along a length of the tubular body, the body comprises a second attachment groove located at a second location along the length of the tubular body, and the attachment device is configured to attach to the tubular body at either the first attachment groove or the second attachment groove.

11. The heating device of claim 8, wherein the electrical resistance heating element is one of a plurality of electrical resistance heating elements, each of the plurality of electrical resistance heating elements having a first end attached to the body proximate the first end of the tubular body and a second end attached to the attachment device.

12. The heating device of claim 8, wherein the tubular body has an elongate shape extending from the fluid inlet to the fluid outlet.

13. The heating device of claim 8, wherein the attachment device is a clip and is detachably attachable to the tubular body.

14. The heating device of claim 8 further comprising:

an optical sensor configured to detect light emitted by the electrical resistance heating element.

15. The heating device of claim 14, wherein:

the heating chamber includes an opening, and the optical sensor is aligned with the opening.

16. The heating device of claim 14, wherein:

the optical sensor is one of a plurality of optical sensors, the heating chamber includes a plurality of openings, and each optical sensor of the plurality of optical sensors is aligned with a corresponding opening of the plurality of openings.

17. The heating device of claim 14, further comprising:

a translucent filter, wherein the translucent filter is configured to reduce an amount of infrared light received by the optical sensor.

18. The heating device of claim 14, further comprising:

processing circuitry configured to receive signals from the optical sensor.

19. The heating device of claim 18, wherein the processing circuitry is configured to deactivate the electrical resistance heating element in response to the optical sensor detecting a predetermined amount of light.

20. The heating unit of claim 8, wherein the electrical resistance heating element comprises an alloy in the form of a coil.

* * * * *